US008434165B2

(12) United States Patent
Cho

(10) Patent No.: US 8,434,165 B2
(45) Date of Patent: May 7, 2013

(54) HEADGEAR WITH WOODEN PATCH

(75) Inventor: Byoung-Woo Cho, Gyeonggi-do (KR)

(73) Assignee: Yupoong, Inc., Seoul (KR)

( * ) Notice: Subject to any disclaimer, the term of this patent is extended or adjusted under 35 U.S.C. 154(b) by 479 days.

(21) Appl. No.: 11/871,268

(22) Filed: Oct. 12, 2007

(65) Prior Publication Data

US 2009/0094871 A1 Apr. 16, 2009

(51) Int. Cl.
*A42B 1/00* (2006.01)

(52) U.S. Cl.
USPC ..... 2/195.1

(58) Field of Classification Search ..... 2/209.13, 2/195.1; 428/172
See application file for complete search history.

(56) References Cited

U.S. PATENT DOCUMENTS 2,774,074 A * 12/1956 Lehmann ..... 2/97
3,673,611 A * 7/1972 Cain et al. ..... 2/175.1
6,035,446 A * 3/2000 Johnson ..... 2/200.1
6,397,390 B1 * 6/2002 Henderson et al. ..... 2/69
6,675,512 B1 * 1/2004 Shwartz et al. ..... 40/329
6,986,166 B2 * 1/2006 Cho ..... 2/195.5
2007/0022516 A1 * 2/2007 Wuensche et al. ..... 2/172

OTHER PUBLICATIONS

Butyl Rubber disclosure.*

* cited by examiner

*Primary Examiner* — Katherine Moran
(74) *Attorney, Agent, or Firm* — Fellers, Snider, Blankenship, Bailey & Tippens, P.C.

(57) ABSTRACT

The present invention relates to a wooden patch and a manufacturing method thereof using a laser. The wooden patch is adhered to clothes, shoes, and headgear as an accessory. In the manufacturing method, since a predetermined pattern is processed on the wooden patch by a laser, the wooden patch may be cut out without cracks or thermal transformation, raised and depressed portion may be variously formed, and gray-scales may be realized. In addition, since a resin patch portion is provided to a rear surface of the wooden patch and the wooden patch is adhered to a product by a self-adhesive characteristic or a thermal process, a fabric panel may not be deteriorated, and a wearer may not be hurt. Further, environmentally-friendly beauty may be provided.

4 Claims, 6 Drawing Sheets

HEADGEAR WITH WOODEN PATCH

BACKGROUND OF THE INVENTION (a) Field of the Invention

The present invention relates to a wooden patch and a manufacturing method thereof using a laser. The wooden patch is adhered to clothes, shoes, and headgear as an accessory.

(b) Description of the Related Art

In general, accessories for clothes, headgear, or shoes are manufactured by using rubber, resin, and metal materials so that the accessories may be easily treated and attached to the clothes, headgear, or shoes.

When the accessories are formed by using the rubber and resin materials, a rubber solution or a resin solution is provided to a mold and then solidified to form a predetermined shape of the accessory, or one or a plurality of films are accumulated and processed by high frequency or ultrasonic waves to form the predetermined shape.

In this case, environmentally-friendly materials are not used to form the accessories manufactured as above, and the accessory is attached to a fabric panel surface by melting a film on a back surface of the accessory with a high temperature or by sewing the accessory to the fabric panel surface.

In addition, when the accessories are formed by using the metal material, molten metal is provided to a mold and cooled to form a predetermined shape, a pin is formed on a back surface of the accessory, a hole is bored through a fabric panel, the pin is penetrated through the fabric panel, and the pin is fixed by using fixing members.

Accordingly, a design thereof may not be delicate or natural, the pin on the back of the accessory may deteriorate the fabric panel, and a wearer may be hurt by external impact.

In addition, there is a problem in that the accessories formed by using the rubber, resin, and metal materials are detrimental to children when they put the accessories into their mouth.

To solve the above problems, wood is used to form the accessories, but the wood may shrink or twist when being dried. In addition, since the wood has poor solidity such that it is easily deteriorated and strength against shear stress is very low, it is difficult to form a desired pattern or letters.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a wooden patch for providing various patterns and shapes without melting or pressing materials, and a manufacturing method thereof using a laser.

In addition, the present invention has been made in an effort to provide a wooden patch for providing environmentally-friendly and natural beauty, and a manufacturing method thereof using a laser.

Further, the present invention has been made in an effort to provide a wooden patch that can be adhered to a fabric panel without deteriorating the fabric panel, and a manufacturing method thereof using a laser.

According to an exemplary embodiment of the present invention, a wooden patch in which a predetermined pattern is formed by using a laser includes a wooden accessory portion, and an adhesive resin patch. The wooden accessory portion has at least one raised portion and one depressed portion. The adhesive resin patch portion is disposed on a rear surface of the wooden accessory portion and freely adheres the wooden patch in a predetermined position.

The wooden accessory portion may be formed of one of medium density fiberboard (MDF), laminated wood, plywood, and particle board (PB), or a combination thereof. In addition, the wooden accessory portion may further include designed wood on an upper part thereof.

The at least one raised portion and one depressed portion of the wooden accessory portion may be processed by a laser so that depths thereof may be different, and the adhesive resin patch portion may be formed of a self-adhesive non-vulcanized rubber.

In a manufacturing method of a wooden patch by using a laser according to another exemplary embodiment of the present invention, a wooden accessory portion material including one of wood, medium density fiberboard (MDF), laminated wood, plywood, and particle board (PB), or a combination thereof is prepared, a pattern including at least one raised portion and one depressed portion that are processed on the wooden accessory portion material is scanned, the scanned pattern is input to a laser system, the at least one raised portion and one depressed portion are formed by performing a scanning operation with different laser beam depths according to the input pattern by the laser system, and a wooden accessory portion is formed, and an adhesive resin patch portion is disposed on a rear surface of the wooden accessory portion.

The laser system may move a focus in a translational motion to form the raised portion and the depressed portion without a thermal transform range, and may simultaneously process patterns of a diameter of 300 to 500 mm to the wooden accessory portion. In addition, the laser system may be a pulse CO2 laser system having a 10.6 um wavelength.

The laser beam scanned by the laser system may have a spot size of 0.3 to 0.6 mm, and may simultaneously process the raised portion and the depressed portion at a processing speed of 150 to 600 mm/s. In addition, an output of the laser system may be maintained to be within 50 to 100 W.

DETAILED DESCRIPTION OF THE EMBODIMENTS

Figure 1:
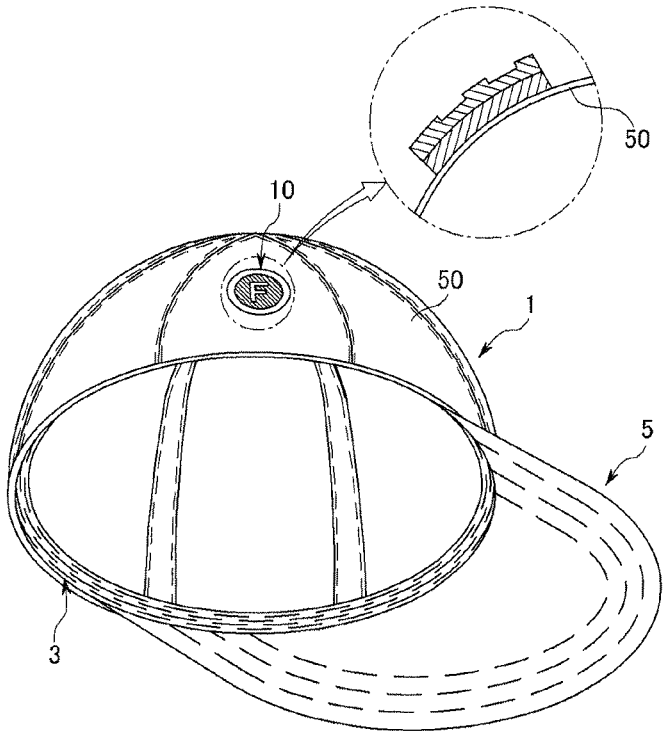
FIG. 1 is a perspective view of a cap to which a wooden patch according to an exemplary embodiment of the present invention is attached.

A wooden patch according to an exemplary embodiment of the present invention and a manufacturing method thereof will now be described.

In the following detailed description, only certain exemplary embodiments of the present invention have been shown and described, simply by way of illustration. As those skilled in the art would realize, the described embodiments may be modified in various different ways, all without departing from the spirit or scope of the present invention.

Accordingly, the drawings and description are to be regarded as illustrative in nature and not restrictive. Like reference numerals designate like elements throughout the specification.

Throughout this specification and the claims that follow, unless explicitly described to the contrary, the word "wood" will be understood to imply the inclusion of logged trees, medium density fiberboard (MDF) formed by compressing sawdust or fibers obtained from a tree, laminated wood formed by cutting wooden materials and performing an adhesive process with a high frequency, plywood formed by cutting wooden materials to be thin sheets and adhering the sheets so that fiber directions of neighboring sheets cross each other, and particle board (PB) made of wood fragments, such as chips or shavings, that are mechanically pressed into sheet form and bonded together with resin.

While a wooden patch according to an exemplary embodiment of the present invention is used for accessories attached to headgear, it may be attached to clothes or shoes, and the wooden patch may be formed in two- and three-dimensional shapes.

A wooden patch according to the exemplary embodiment of the present invention will now be described with reference to FIG. 1 to FIG. 3C.

Figure 2:
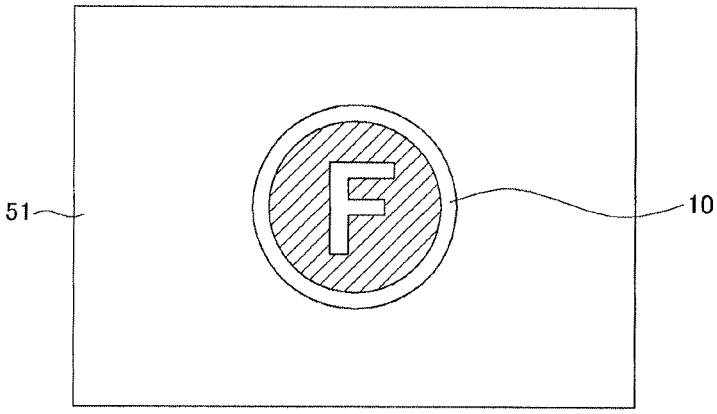
FIG. 2 is a top plan view of a fabric panel to which a wooden patch according to an exemplary embodiment of the present invention is attached.
Figure 3A:
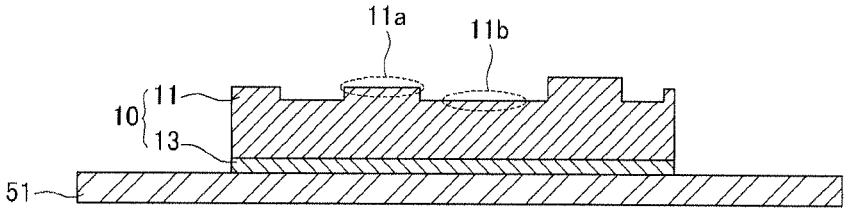
FIG. 3A is a cross-sectional view of a wooden patch according to an exemplary embodiment of the present invention.
Figure 3B:
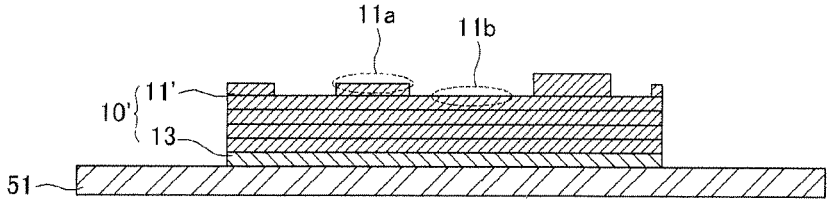
FIG. 3B is a cross-sectional view of a wooden patch according to an exemplary embodiment of the present invention.
Figure 3C:
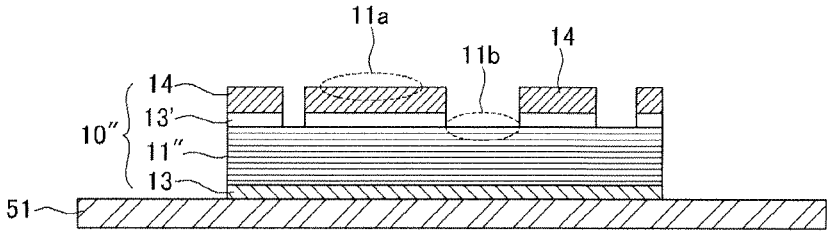
FIG. 3C is a cross-sectional view of the wooden patch according to an exemplary embodiment of the present invention.

FIG. 1 is a perspective view of a cap to which the wooden patch according to the exemplary embodiment of the present invention is attached, FIG. 2 is a top plan view of a fabric panel to which the wooden patch according to the exemplary embodiment of the present invention is attached, and FIG. 3A to FIG. 3C are respectively cross-sectional views of the wooden patch according to first, second, and third exemplary embodiments of the present invention.

Referring to FIG. 1, a cap 1 according to the exemplary embodiment of the present invention includes a head accepting portion 3 disposed to surround a head of a wearer and a visor portion 5 combined to a side of a lower part of the head accepting portion 3, and the head accepting portion 3 may be formed by sewing panels 50 that are cut out in a predetermined shape.

The cap 1 according to the exemplary embodiment of the present invention includes a wooden patch 10 that is combined to the panel 50 of the head accepting portion 3 along a curved surface of the panel 50 of the head accepting portion 3.

As shown in FIG. 2, the wooden patch 10 according to the exemplary embodiment of the present invention may be flatly adhered on a fabric panel 51.

To adhere the wooden patch 10 to the fabric panel 51 as described above, as shown in FIG. 3A, the wooden patch 10 according to the exemplary embodiment of the present invention includes a wooden accessory portion 11 and a flexible resin patch portion 13 that is disposed on a rear surface of the wooden accessory portion 11 so that the wooden patch 10 may be freely adhered at a predetermined position of the fabric panel.

The wooden accessory portion 11 includes a raised portion 11*a* and a depressed portion 11*b*, and environmentally-friendly beauty may be shown according to the raised portion 11*a* and the depressed portion 11*b*.

The resin patch portion 13 may be formed by coating a synthetic resin having a self-adhesive property or by coating a synthetic resin that is adhesive when melted. According, the fabric panel may be prevented from being damaged by riveting a pin to the fabric panel, and a wearer may not be hurt by external impact.

When the resin patch portion 13 is formed of non-vulcanized rubber (e.g., isobutylene isoprene rubber (IIR)), it has the self-adhesive property and therefore the resin patch portion 13 may be adhered without an additional adhesive agent. In addition, since the resin patch portion 13 uses the non-vulcanized rubber, it is environmentally friendly.

Further, when the resin patch portion 13 is formed of a urethane resin or a polyamide resin and is heated by a thermal forming device at 150 degrees to 180 degrees, it may be adhered around the fabric panel 51 without contaminating the wooden patch, and it may be integrally adhered to the fabric panel 51 without thermally deteriorating the fabric panel 51.

Referring to FIG. 3B, in a like manner of FIG. 3A, a wooden patch 10' according to a second exemplary embodiment of the present invention includes a wooden accessory portion 11' including the raised portion 11*a* and the depressed portion 11*b*, and the resin patch portion 13 that is adhered to the rear surface of the wooden accessory portion 11. However, the wooden accessory portion 11' is not integrally formed, but it is formed of plywood formed by accumulating multiple layers of thin wooden sheets.

In the wooden patch 10' according to the second exemplary embodiment of the present invention, since a laser system 100 is used to adhere the multiple layers of thin sheets by an adhesive agent, the raised portion 11*a* and the depressed portion 11*b* may be delicately formed without any cracks on the wooden accessory portion 11' having less durability. The laser system 100 will be described later in the specification.

Referring to FIG. 3C, in a like manner of FIG. 3A, a wooden patch 10" according to a third exemplary embodiment of the present invention includes a wooden accessory portion 11" including the raised portion 11*a* and the depressed portion 11*b* and the resin patch portion 13 adhered to a rear surface of the wooden accessory portion 11". However, to improve the beauty, an adhesive agent layer 13' is formed by coating an adhesive agent on an upper part of the wooden accessory portion 11", and designed wood 14 is additionally formed.

In the wooden patch 10" according to the third exemplary embodiment of the present invention, since the laser system 100 is used to adhere the multiple layers of thin sheets and the designed wood 14 by the adhesive agent, the raised portion 11*a* and the depressed portion 11*b* may be delicately formed on the wooden accessory portion 11" that has less durability and is formed by different materials without any cracks around the raised portion 11*a* and the depressed portion 11*b*.

Since the resin patch portion 13 has the self-adhesive property when it is formed of the non-vulcanized rubber (e.g., the IIR), the resin patch portion 13 may be adhered without an additional adhesive agent. In addition, since the resin patch portion 13 uses the non-vulcanized rubber, it is environmentally friendly.

Further, when the resin patch portion 13 is formed by the urethane resin or the polyamide resin and is heated by the thermal forming device at 150 degrees to 180 degrees, it may be adhered around the fabric panel 51 without contaminating the wooden patch, and it may be integrally adhered to the fabric panel 51 without thermally deteriorating the fabric panel 51.

Figure 4:
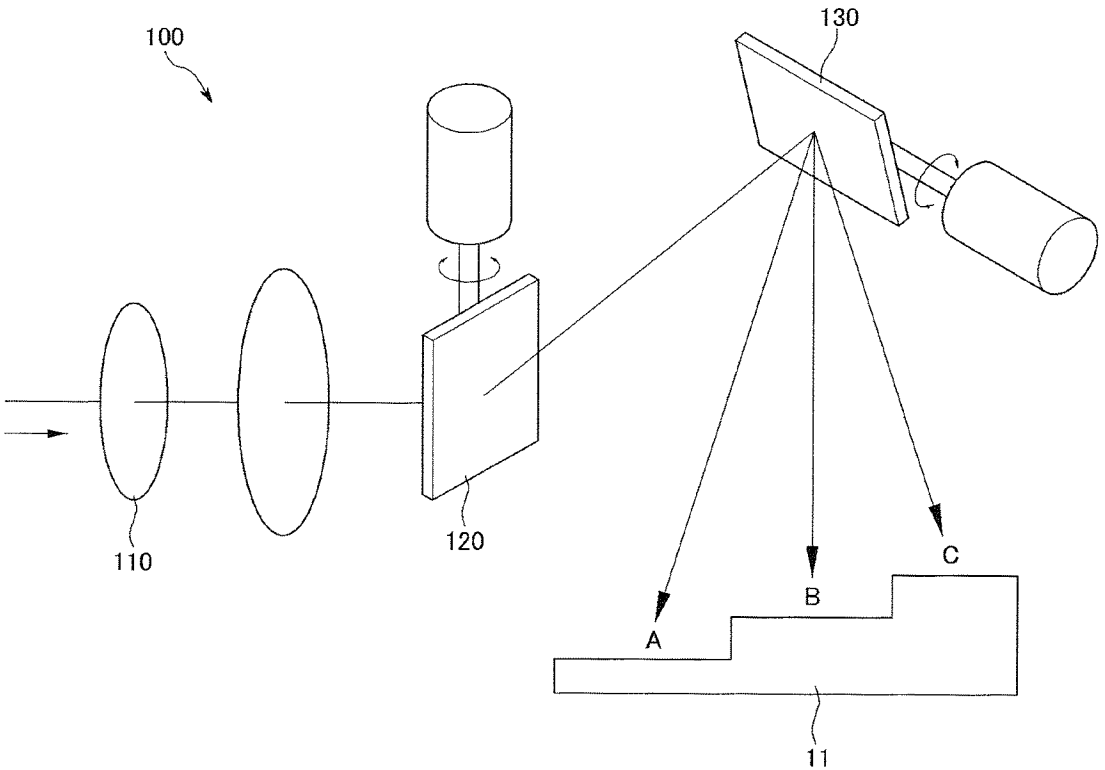
FIG. 4 is a schematic diagram of a laser system to describe a manufacturing method of a wooden patch by using a laser.

A manufacturing method of the wooden patch by using a laser according to the exemplary embodiment of the present invention will now be described with reference to FIG. 4.

Since the laser system 100 according to the exemplary embodiment of the present invention may scan laser beams to the wooden patch 10 with depth differences (e.g., A, B, and C in FIG. 4) by using reflecting mirrors 120 and 130 that dynamically rotate, a desired pattern of the raised portion 11*a* and the depressed portion 11*b* may be formed on the wooden patch 10.

Firstly, the desired pattern of the raised portion 11*a* and the depressed portion 11*b* is scanned to the wooden patch 10.

The laser system 100 receives the scanned pattern, forms a laser graphic, and may process the wooden accessory portion 11 with a diameter of 300 to 500 mm with a spot size of 0.3 to 0.6 mm in a depth direction.

In this case, the laser system 100 may simultaneously process the raised portion 11*a* and the depressed portion 11*b* at a processing speed of 150 to 600 mm/s.

As shown in Table 1, cracks are not generated and a desired pattern is formed without generating a thermal transform range when the laser system 100 uses a pulse laser. Accordingly, a pulse CO2 laser with a wavelength of 10.6 um is appropriately used since the pulse CO2 laser provides various outputs of several kWs and cracks are not generated when the wooden accessory portion 11 is processed.

TABLE 1

| | Type of Laser | | | |
|---|---|---|---|---|
| | Pulse CO2 Laser | Excimer laser 200-400 nm | 1.06 um YAG laser | CO2 laser of 10.6 um wavelength |
| State: Cracks/ Thermal transformation range | No/No | Yes/No | Yes/No | Yes/Yes |

In this case, when an output of the laser system 1 is maintained within 50 to 100 W, a desired pattern may be formed without deteriorating the wooden accessory portion 11.

As described above, as shown in FIG. 1, the wooden patch 10 may be flatly or stereoscopically processed to correspond to the panel 50 of the head accepting portion 3 of the cap 1.

In addition, since the raised portion 11*a* and the depressed portion 11*b* are formed by the laser graphic, a line, a surface, and grayscales may be realized.

Further, when a color material is printed on the raised portion 11*a* of the wooden accessory portion 11 and the laser beam is scanned thereto, a color pattern may be realized.

According to modified exemplary embodiments of the present invention, in the wooden accessory portions 11' and 11" that may be formed by a medium density fiberboard (MDF) formed by compressing sawdust or fibers obtained from a tree, laminated wood formed by cutting wooden materials and performing an adhesive process with a high frequency, plywood formed by cutting wooden materials to be thin sheets and adhering the sheets so that fiber directions of neighboring plates cross each other, and particle board (PB) made of wood fragments such as chips or shavings that are mechanically pressed into sheet form and bonded together with resin, a pattern may be processed without any damage, and a focusing lens 110 may be moved in a translational motion along a focus direction to scan the laser beam to the adhesive agent adhering the thin wooden plates.

According to the exemplary embodiments of the present invention, since a laser is used to melt or press materials, a wooden patch for providing various patterns and shapes may be formed without generating polluting materials.

In addition, environmentally-friendly and natural beauty may be provided, and a wooden patch having stereoscopic patterns and various colors may be provided.

Further, a wooden patch that may be adhered to a fabric panel without deteriorating the fabric panel and may not contaminate other parts of the fabric panel may be provided.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. Headgear consisting of a head accepting portion to be put around a head circumference, a visor portion combined with a lower part of the head accepting portion, and a wooden patch that is adhered to the head accepting portion, said patch includes a predetermined pattern processed by a laser, the wooden patch consisting of:

a single member wooden accessory portion consisting of at least one raised portion and one depressed portion; and an adhesive resin patch portion disposed on said rear surface of the wooden accessory portion such that the wooden patch is freely adhered to a predetermined position.

2. The headgear of claim 1, wherein the wooden accessory portion comprises designed wood and is formed of one of medium density fiber board (MDF), laminated wood, plywood, and particle board (PB), or a combination thereof on an upper part thereof.

3. The headgear of claim 2, wherein at least one raised portion and one depressed portion of the designed wood are processed by a laser so that depths thereof may be different.

4. The headgear of claim 1, wherein the adhesive resin patch portion is formed of a synthetic self-adhesive non-vulcanized rubber.

* * * * *